US007544259B2

(12) United States Patent
Funaki et al.

(10) Patent No.: US 7,544,259 B2
(45) Date of Patent: Jun. 9, 2009

(54) COPPER ALLOY, COPPER ALLOY PRODUCING METHOD, COPPER COMPLEX MATERIAL, AND COPPER COMPLEX MATERIAL PRODUCING METHOD

(75) Inventors: Mitsuhiro Funaki, Sayama (JP); Hiroki Baba, Sayama (JP); Shinya Ohyama, Sayama (JP); Toshiyuki Horimukai, Sayama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 597 days.

(21) Appl. No.: 10/521,333

(22) PCT Filed: Jul. 17, 2003

(86) PCT No.: PCT/JP03/09102

§ 371 (c)(1),
(2), (4) Date: Mar. 15, 2005

(87) PCT Pub. No.: WO2004/009859

PCT Pub. Date: Jan. 29, 2004

(65) Prior Publication Data

US 2005/0205176 A1 Sep. 22, 2005

(30) Foreign Application Priority Data

| | | |
|---|---|---|
| Jul. 18, 2002 | (JP) | 2002-210153 |
| Jul. 18, 2002 | (JP) | 2003-210152 |
| Jan. 7, 2003 | (JP) | 2003-000919 |
| Jul. 17, 2003 | (JP) | 2003-198393 |
| Jul. 17, 2003 | (JP) | 2003-198394 |
| Jul. 17, 2003 | (JP) | 2003-198397 |

(51) Int. Cl.
*C22C 9/00* (2006.01)

(52) U.S. Cl. ..... 148/683; 148/680; 148/681; 148/682

(58) Field of Classification Search ..... 148/680–683
See application file for complete search history.

(56) References Cited

U.S. PATENT DOCUMENTS

| | | | | |
|---|---|---|---|---|
| 4,445,350 | A * | 5/1984 | Nishihara et al. | 72/38 |
| 4,640,723 | A * | 2/1987 | Sugai et al. | 148/411 |
| 2002/0157741 | A1 | 10/2002 | Yamamoto et al. | |

FOREIGN PATENT DOCUMENTS

| | | |
|---|---|---|
| JP | 59-150043 | 8/1984 |
| JP | 60-141802 | 7/1985 |

(Continued)

*Primary Examiner*—Sikyin Ip
(74) *Attorney, Agent, or Firm*—Rankin, Hill & Clark LLP

(57) ABSTRACT

An element such as Cr is caused to dissolve sufficiently in a base-material metal (Cu) in a solid solution state at a high temperature and a material in a supersaturated condition is obtained by performing quenching. After that, a strain is applied to this material and this material is subjected to aging treatment at a low temperature simultaneously with or after the application of this strain. As a result of this, it is possible to obtain a copper alloy having properties desirable as an electrode material, for example, a hardness of not less than 30 HRB, an electrical conductivity of not less than 85 IACS %, and a thermal conductivity of not less than 350 W/(m·K).

2 Claims, 20 Drawing Sheets

FOREIGN PATENT DOCUMENTS

| | | |
|---|---|---|
| JP | 03-241126 | 10/1988 |
| JP | 02-093029 | 4/1990 |
| JP | 02-038541 | 7/1990 |
| JP | 04-080301 | 3/1992 |
| JP | 06-108182 | 4/1994 |
| JP | 09-137244 | 5/1997 |
| JP | 10-258334 | 9/1998 |
| JP | 11-050177 | 2/1999 |
| JP | 11-114618 | 4/1999 |
| JP | 11-140568 | 5/1999 |
| JP | 11-323463 | 11/1999 |
| JP | 2000-067642 | 3/2000 |
| JP | 2000-271621 | 3/2000 |
| JP | 2000-355746 | 12/2000 |
| JP | 2002-356726 | 12/2002 |

* cited by examiner

Lateral extrusion (a)

(b)

Relation between die temperature and hardness

Relation between die temperature and electrical conductivity

Relation between die temperature and thermal conductivity

Electrical conductivity of Cu-Ti alloys

Electrical conductivity of Cu-Ti alloys

Hardness of Cu–Ti alloys

Relationship between electrical conductivity and hardness of Cu–Ti alloys (a)

(b)

Relationship between heavy working of Cu-TiB (strain equivalent to 200% elongation and electrical conductivity

COPPER ALLOY, COPPER ALLOY PRODUCING METHOD, COPPER COMPLEX MATERIAL, AND COPPER COMPLEX MATERIAL PRODUCING METHOD

TECHNICAL FIELD

The present invention relates to a copper alloy and a composite copper material that are suitable for wiring connectors of electric vehicles or the like and electrode materials for welding, and methods of manufacturing the copper alloy and the composite copper material.

BACKGROUND ART

With the increasing EV (electric vehicle) design of automobiles, the consumption of harnesses and connectors that are connection parts of wires tends to increase. In the adoption of EVs, ensuring safety and gas mileage by electronic control techniques is also a purpose.

Connectors that are incorporated in automobiles are used in severe environments of high temperature and vibration and, therefore, the reliability of connection and contact stability are required. Also, with increasing adoption of EVs, copper-based materials that have small energy losses, i.e., high conductivity are desired.

Also for electrode materials for welding, properties having values above prescribed ones are required in all respects of mechanical strength, thermal properties and electrical properties.

For mechanical strength, it is known as the Hall-Petch law that mechanical strength is generally improved by refining the crystal structures of metal materials.

For example, when metal or alloy materials are deformed, material strength increases due to work hardening. This is understood as follows. That is, various kinds of defects (point defect, dislocation, stacking fault, etc.) are accumulated in materials due to working (plastic deformation), and as a result of the interactions of these defects, the introduction and migration of new defects become difficult and the materials obtain resistance to external force.

To apply plastic deformation (strain) to metal materials, extrusion, drawing, shearing, rolling, forging, etc. have hitherto been carried out. Concretely, the HIP (High Pressure Torsion) process that involves twisting a material while applying high pressure to the material, the CEC (Cyclic Extrusion Compression) process that involves repeatedly threading a material through a constricted pipe, and the ARB (Accumulative Roll Bonding) process that involves cutting a metal sheet the thickness of which has been reduced by rolling and repeatedly rolling superimposed metal sheets have been proposed, and in particular, as a concrete method of refining the grains of an aluminum alloy, the ECAE (equal-channel-angular extrusion) process that involves applying shearing deformation to a material by lateral extrusion without a reduction of sectional area of the material has been proposed as disclosed in the Japanese Patent Laid-Open No. 9-137244, the Japanese Patent Laid-Open No. 10-258334, the Japanese Patent Laid-Open No. 11-114618, the Japanese Patent Laid-Open No. 2000-271621, etc.

On the other hand, for copper alloys, methods disclosed in the Japanese Patent Laid-Open No. 11-140568, the Japanese Patent Laid-Open No. 2000-355746, etc. have been proposed. In these conventional techniques, to improve the properties (machinability and dezincification corrosion) of brass (Cu—Zn) that is used as a material for water faucet fittings and the like among other copper alloys, dynamic recrystallization is caused to occur by hot extrusion thereby to obtain the refinement of crystal grains and specific ratios of crystal structures (ratios of the α-phase, β-phase and γ-phase).

Also, to bring out prescribed properties from age-hardening type copper alloys to which an element that does not dissolve or scarcely dissolves in a solid solution state at room temperature, such as chromium (Cr), zirconium (Zr), beryllium (Be), titanium (Ti) and boron (B), is added, this element is first caused to dissolve sufficiently in a solid solution sate at a high temperature and then quenched and brought to a supersaturated condition, which is followed by aging treatment at a prescribed temperature, thereby causing the added element in a supersaturated condition to precipitate.

Even when the above-described work aging or aging treatment for aluminum alloys and copper alloys is applied as it is to age-hardening type copper alloys to which an element, such as chromium (Cr), zirconium (Zr), beryllium (Be), titanium (Ti) and boron (B), is added, it is impossible to simultaneously satisfy all respects of mechanical strength, thermal properties and electrical properties.

That is, in order to ensure that the thermal properties and electrical properties required of connectors used in electric vehicles or the like, electrode materials, etc. are developed, it is necessary to ensure that an added element that dissolves in a solid solution state is caused to precipitate in the largest possible amount. In order to cause this element to precipitate in a large amount, it is necessary to raise the aging temperature. However, when the aging temperature is raised, grain growth proceeds and mechanical properties decrease. That is, mechanical strength and thermal and electrical properties are in a tradeoff relation.

For thermal properties and electrical properties, copper alloys in which an oxide such as alumina is dispersed in the copper matrix are excellent in electrical conductivity and heat resistance and, therefore, these copper alloys are widely used in materials for electric parts. Many proposals to improve the properties and manufacturing methods of these copper alloys have been made.

For example, a proposal has been made to improve electrical conductivity and softening properties by adding, as elements that perform internal oxidation, not only aluminum, but also tin as a third element. (Japanese Patent Laid-Open No. 59-150043)

There has been proposed a copper alloy in which the amount of particles of not more than 50 μm is not less than 70 wt % owing to the use of a copper alloy powder of not more than 300 μm which is manufactured by the atomizing process and in which a readily oxidizing metal such as aluminum is caused to dissolve in a solid solution state. (Japanese Patent Laid-Open No. 60-141802)

There has also been proposed a method that involves internally oxidizing a Cu—Al alloy powder thereby to convert Al to $Al_2O_3$, making the surface of this alloy powder smooth, green compacting the powder to form a green compact, and hot forging this green compact at 600 to 1,000° C. (Japanese Patent Laid-Open No. 63-241126)

Also, there has been proposed a method that involves internally oxidizing a plate-like copper alloy containing Al to convert Al to $Al_2O_3$, working this plate-like alloy in coil form, sealing this coiled alloy in a metal tube, and hot working this metal tube at 900° C. in a desired shape. (Japanese Patent Laid-Open No. 2-38541)

Also, there has been proposed a method that involves filling an alloy powder obtained by internally oxidizing Cu—Al alloy chips in a carbon die and hot pressing the alloy powder at 900° C. and at a pressure of 400 kg/cm$^2$. (Japanese Patent Laid-Open No. 2-93029)

Furthermore, there has been proposed a method that involves improving sinterability by causing an annular hard layer of $Al_2O_3$ to be present in the interior of a Cu—Al alloy powder. (Japanese Patent Laid-Open No. 4-80301)

In all of the above-described conventional techniques, hot working at high temperatures is performed and, therefore, structures tend to become coarse due to grain growth. Thus, in the conventional methods, it is impossible to obtain materials that simultaneously satisfy, as the properties required of connectors of electric vehicles and electrode materials for welding, the requirements that hardness be not less than 30 HRB, preferably not less than 40 HRB, that electrical conductivity be not less than 85 IACS %, preferably not less than 90 IACS %, and that thermal conductivity be not less than 350 W/(m·K), preferably not less than 360 W/(m·K).

When hardness is not less than 30 HRB, it is possible to prevent the tip of an electrode material from becoming deformed and generating heat. When electrical conductivity is not less than 85 IACS %, it is possible to prevent an electrode material from reacting with a steel sheet and sticking to the steel sheet. When thermal conductivity is not less than 350 W/(m·K), it is possible to prevent the deposition of an electrode material during welding because the cooling efficiency increases.

Because $Al_2O_3$ does not dissolve in Cu in a solid solution state even at a high temperature, a conventional technique by which $Al_2O_3$ is caused to precipitate by aging treatment after dissolution in a solid solution cannot be applied to a Cu—Al alloy.

DISCLOSURE OF THE INVENTION

A material that simultaneously satisfies all of the mechanical strength, thermal properties and electrical properties required of a material for connectors used in the wiring of electric vehicles or an electrode material for welding is obtained by ensuring that a second element that dissolves in a solid solution state at a high temperature, but does not dissolve or scarcely dissolves in a solid solution state (cannot maintain a solid solution state) at room temperature is caused to dissolve in a base-material metal (Cu) in a solid solution state, that crystal grain refinement is achieved by applying a strain equivalent to an elongation of not less than 200% to this material, and that this material is subjected to aging treatment simultaneously with or after the application of this strain, thereby to promote precipitation of the second element among crystal grains.

Concretely, in a copper alloy containing a second element that does not dissolve or scarcely dissolves in a solid solution state at room temperature, it is possible to obtain a copper alloy the average grain size of which is not more than 20 μm and in which the second element precipitates among crystal grains. This copper alloy has a hardness of not less than 30 HRB, an electrical conductivity of not less than 85 IACS %, and a thermal conductivity of not less than 350 W/(m·K). The second element is any of chromium (Cr), zirconium (Zr), beryllium (Be), titanium (Ti) and boron (B).

Extrusion, drawing, shearing, rolling or forging can be considered as means for applying a strain to the material and conditions for the extrusion are such that lateral extrusion is performed at a die temperature of 400 to 500° C. and an extrusion speed of 0.5 to 2.0 mm/sec. It is also possible that before a strain is applied to the material, the material is subjected to aging treatment beforehand.

On the other hand, in order to obtain a material that simultaneously satisfies all of the mechanical strength, thermal properties and electrical properties from a ceramic powder (alumina or titanium boride) that does not dissolve in copper in a solid solution state even at a high temperature, a copper powder and a ceramic powder are mixed together, thereby to form a mixed powder as a primary shaped body, and a strain is applied to this primary shaped body, thereby to form a secondary shaped body in which base material and ceramic particles are combined together with refined particle sizes. As a result of this, a composite copper material having a hardness of not less than 60 HRB, an electrical conductivity of not less than 85 IACS %, a thermal conductivity of not less than 350 W/(m·K), and a hardness of not less than 30 HRB is obtained.

Incidentally, as the means for applying a strain, for example, lateral extrusion is performed at a material temperature of not less than 400° C. but not more than 1,000° C. and a die temperature of not less than 400° C. but not more than 500° C. Why the specified raw material temperature is 400° C. to 1,000° C. is that if the raw material temperature is less than 400° C., extrusion becomes difficult because of large deformation resistance and sufficient bonding strength cannot be obtained between the parent phase (matrix) and particles and that if the raw material temperature exceeds 1,000° C., this temperature exceeds the melting point of copper and copper melts, making it impossible to apply a strain. The reason why the specified die temperature is 400° C. to 500° C. is that if the die temperature is too low, extrusion becomes difficult and if die temperature is too high, the die itself becomes annealed.

The primary shaped body can be obtained by green compacting or by filling the mixed powder in a tube. Furthermore, the average particle size of the ceramic powder is 0.3 to 10 μm, a strain applied to the primary shaped body is equivalent to an elongation of not less than 200%, the average particle size of a base material of the secondary shaped body to be obtained is not more than 20 μm, and the average particle size of ceramic particles is not more than 500 nm.

As described above, because titanium boride is not mixed with a copper power and instead, a titanium powder that becomes titanium boride as a result of a reaction and a boron powder are formed in the copper matrix, it is possible to increase mechanical strength as fine particles. Therefore, in another aspect of the invention, a method of manufacturing a composite copper material in which titanium boride is dispersed in the copper matrix comprises the following steps [1] to [3]:

[1] the step of mixing a copper powder, a titanium powder and a boron powder together, thereby to form a primary shaped body;

[2] the step of giving thermal energy to the primary shaped body, thereby causing the titanium powder and the boron powder to react with each other in order to form titanium boride in a copper matrix; and

[3] the step of applying a strain to the primary shaped body in which the titanium boride is formed by plastically deforming the primary shaped body, thereby to form a secondary shaped body.

For example, if the average grain size of a titanium powder and a boron powder is 0.3 to 10 μm, it can be ensured that the average particle size of a base material of the secondary shaped body to be obtained is not more than 20 μm, and that the average particle size of titanium boride particles is not more than 400 nm, and hence it is possible to obtain a composite copper material having small deformation by pressurization during welding as an electrode material for welding (due to low compressive strength of the material).

Part of titanium and boron dissolve in copper in a solid solution state when thermal energy is applied to the primary shaped body. However, if the titanium and boron in this solid solution state remain in an unreacted condition, the composite copper material is inferior in electrical conductivity and thermal conductivity. Therefore, it is preferred that the secondary shaped body be subjected to heat treatment in the same step as the step of applying a strain by plastic deformation or a step following this step, whereby the unreacted solute elements (titanium and boron) are caused to precipitate.

The means for applying plastic deformation, the material temperature, the die temperature, the extrusion speed and the number of times of extrusion are the same as described above.

BRIEF DESCRIPTION OF THE DRAWINGS

FIG. 3(*b*) is a micrograph of a crystal structure before ECAE treatment;

BEST MODE FOR CARRYING OUT THE INVENTION

Figure 1:
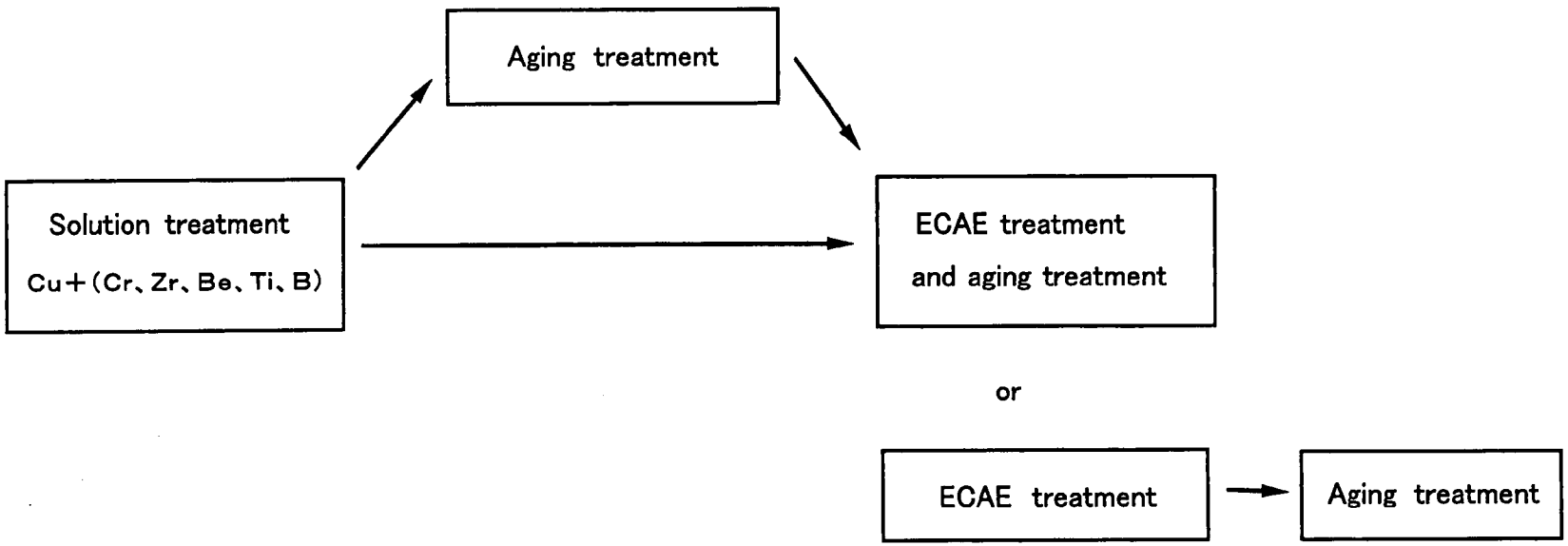
FIG. 1 is a drawing to explain the steps for obtaining a copper alloy related to the invention.

As shown in FIG. 1, first Cr is caused to melt into a base material (Cu) in an amount of 0.1 to 1.4 wt % and a material in which Cr dissolves in Cr in a solid solution state in a supersaturated manner is obtained by quenching the melt. Subsequently, a strain equivalent to an elongation of not less than 200% is applied to this material. Incidentally, it is desirable to use a material that is subjected to aging treatment after solution treatment.

When an added element is Zr, the Zn content is 0.15 to 0.5 wt %. In the case of Be, the Be content is 0.1 to 3.0 wt %. In the case of Ti, the Ti content is 0.1 to 6.0 wt %. And in the case of B, the B content is 0.01 to 0.5 wt %.

Figure 2:
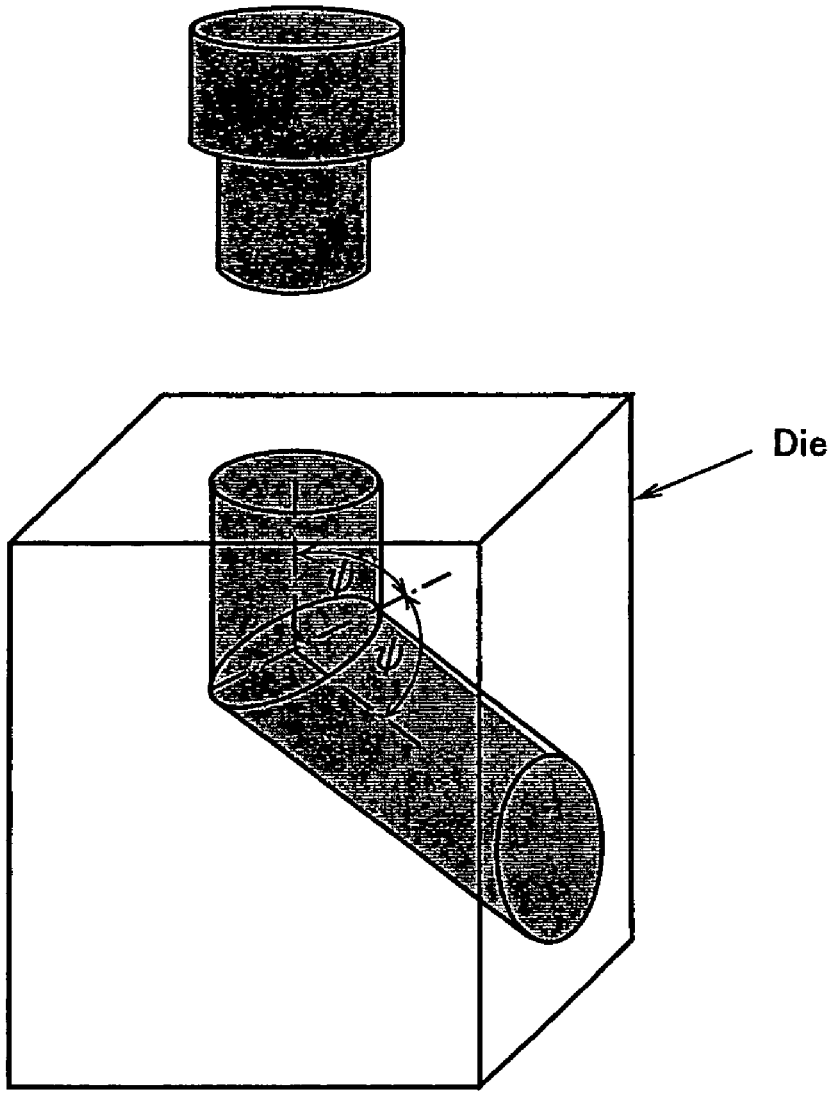
FIG. 2 is a drawing to explain a die used in the ECAE treatment.

FIG. 2 shows a die that applies a strain by use of a Cu tube. The above-described mixture is filled in the Cu tube and extruded at a die temperature of 400 to 500° C. and an extruding speed of about 1 mm/sec by repeating the extrusion four times (ECAE treatment). Thus, a strain is applied to a copper alloy in which Cr dissolves in a solid solution state in a supersaturated manner. By this operation, the crystal grain size decreases to not more than 20 μm from 200 μm.

If Δe: amount of strain, ψ:½ of inner angle of joint, ERR: area ratio before and after working, A0: sectional area before working, A: sectional area after working, EAR: reduction ratio of equivalent sectional area before and after working, EE: equivalent strain (elongation), then the following relationships hold:

$$\Delta e = 2/\sqrt{3}\ \mathrm{cotan}\ \psi$$

$$ERR = A0/A = \exp(\Delta e)$$

$$EAR = (1 - 1/ERR) \times 100$$

$$EE = (ERR - 1) \times 100$$

The crystal structure becomes grain-refined by the above-described lateral extrusion (ECAE treatment). Because extrusion conditions overlap aging treatment, the precipitation of a second element is promoted at the same time with grain refinement.

Figure 3:
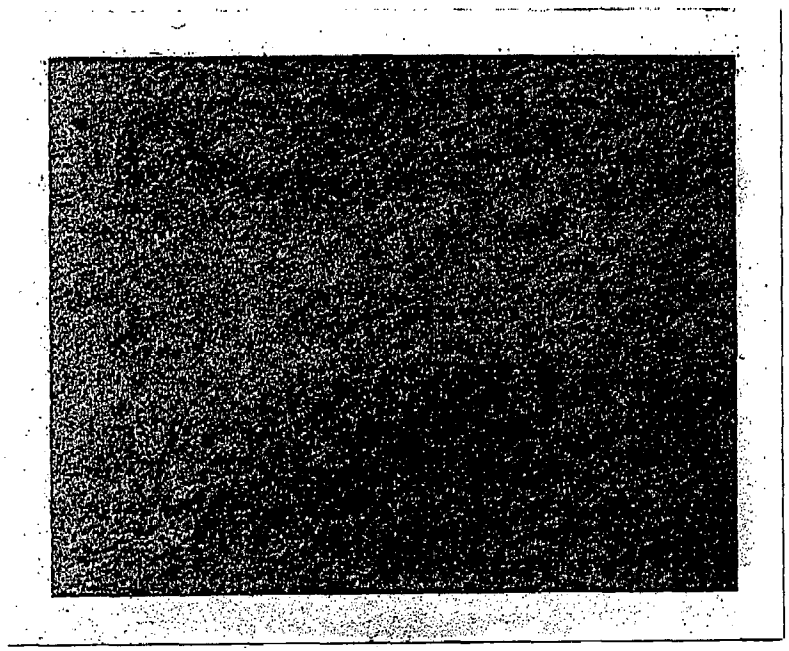
FIG. 3(*a*) is a micrograph of a crystal structure of a copper alloy related to the invention.
Figure 3:
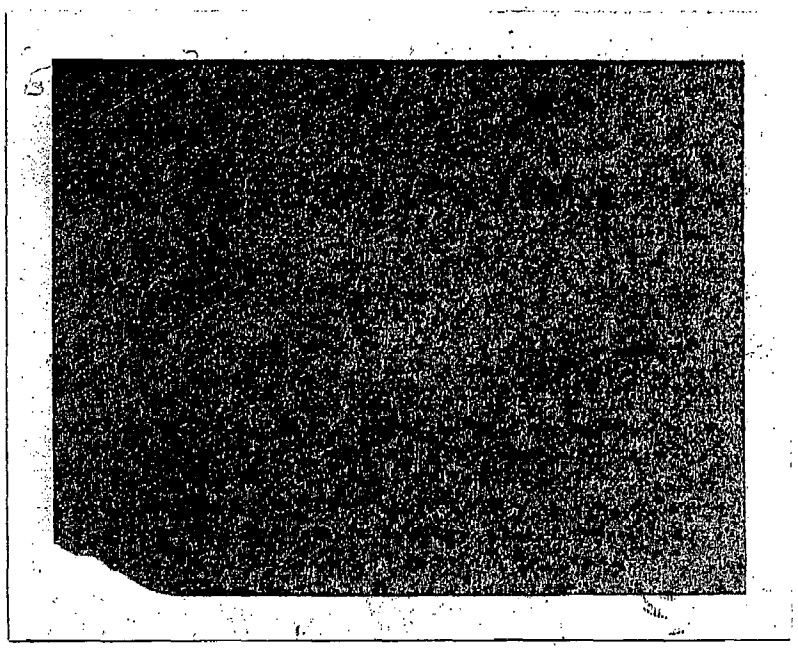

The crystal structure of a copper alloy obtained by this ECAE treatment is shown in a micrograph of FIG. 3(*a*). The crystal structure before ECAE treatment is shown in a micrograph of FIG. 3(*b*). From these micrographs, it is apparent that an added element has precipitated (black points in the photograph) among crystal grains due to the ECAE treatment.

Figure 4:
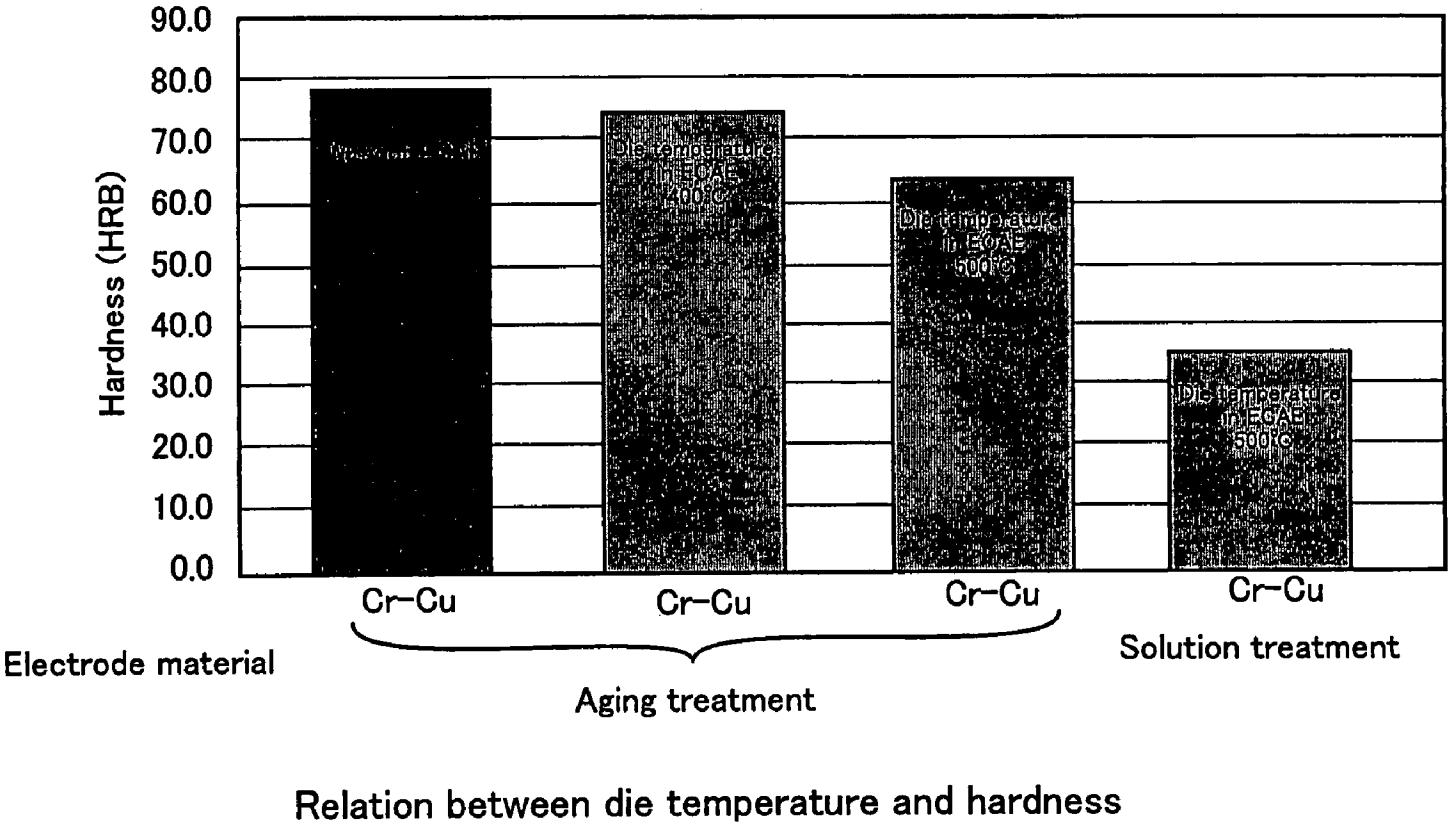
FIG. 4 is a graph that shows the relationship between die temperature and hardness.
Figure 5:
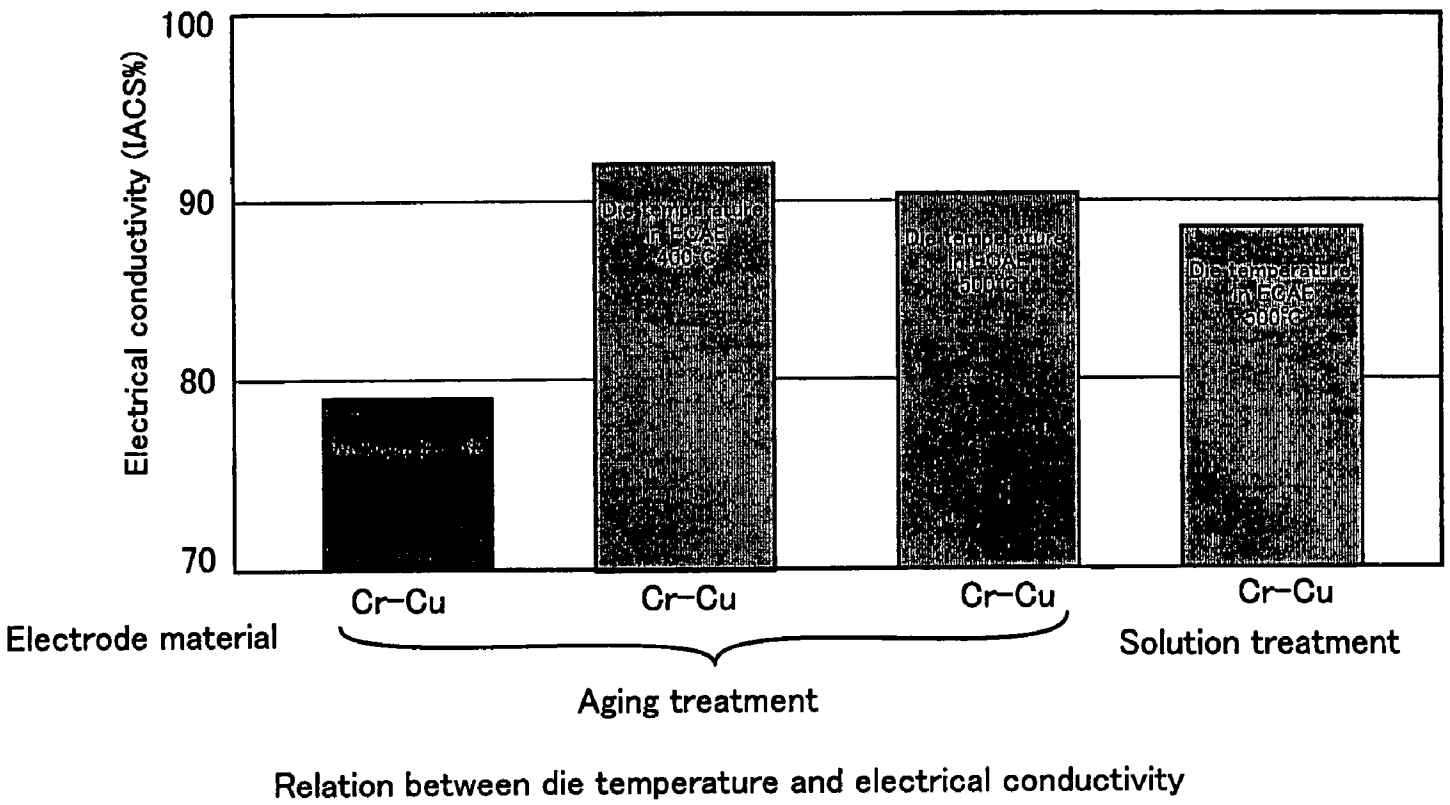
FIG. 5 is a graph that shows the relationship between die temperature and electrical conductivity.
Figure 6:
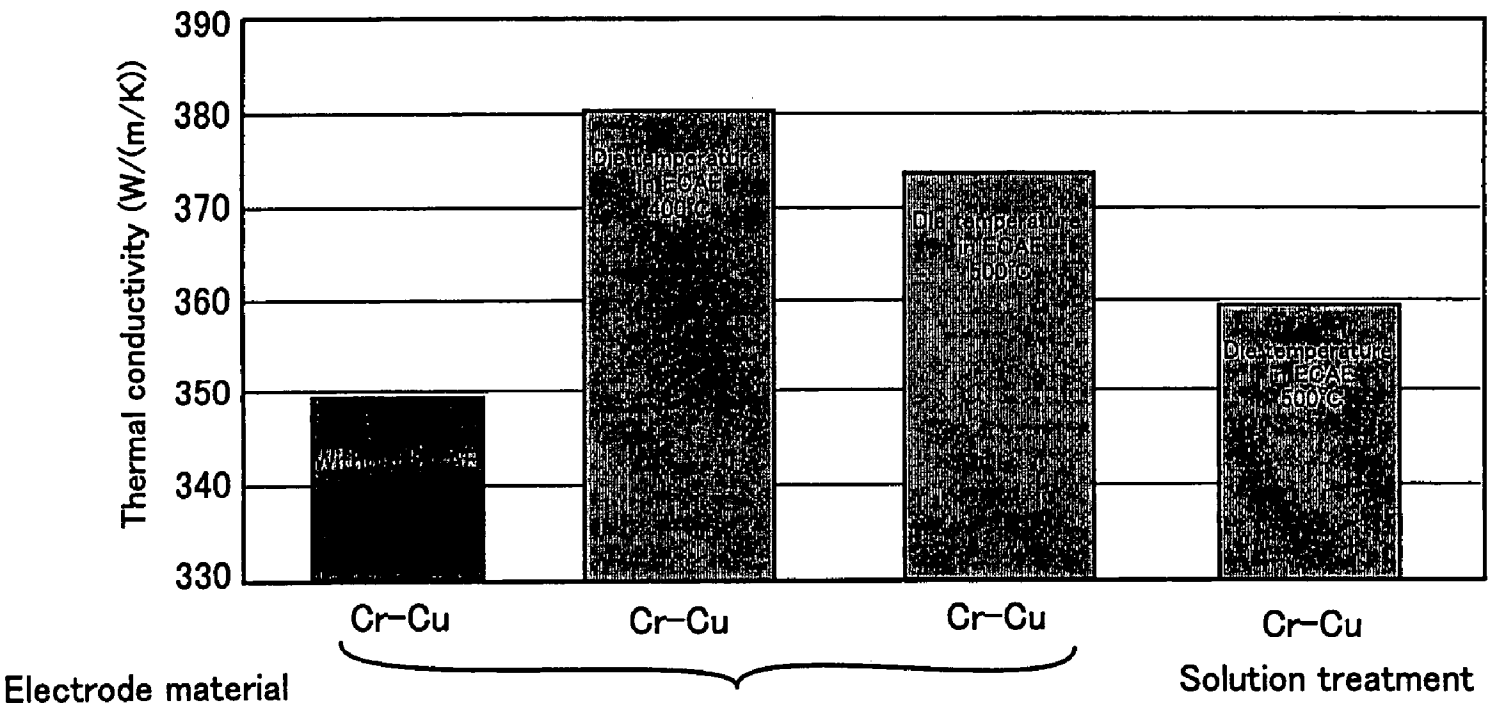
FIG. 6 is a graph that shows the relationship between die temperature and thermal conductivity.

FIG. 4 is a graph that shows the relationship between die temperature and hardness, FIG. 5 is a graph that shows the relationship between die temperature and electrical conductivity, and FIG. 6 is a graph that shows the relationship between die temperature and thermal conductivity. From these graphs it is apparent that a copper alloy related to the invention has properties required of an electrode material such as a welding tip, i.e., a hardness of not less than 30 HRB, an electrical conductivity of not less than 85 IACS %, and a thermal conductivity of not less than 350 W/(m·K).

That is, from FIGS. 4 to 6, it is apparent that a material not subjected to ECAE treatment (solution treatment+aging treatment) is inferior in electrical conductivity and thermal conductivity although it has high hardness, that a material obtained by subjecting a material which has been subjected to only the solution treatment to ECAE treatment is excellent in electrical conductivity and thermal conductivity although it has low hardness, and that a material obtained by subjecting a material which has been subjected to aging treatment after solution treatment to ECAE treatment is excellent in all respects of hardness, electrical conductivity and thermal conductivity.

Figure 7:
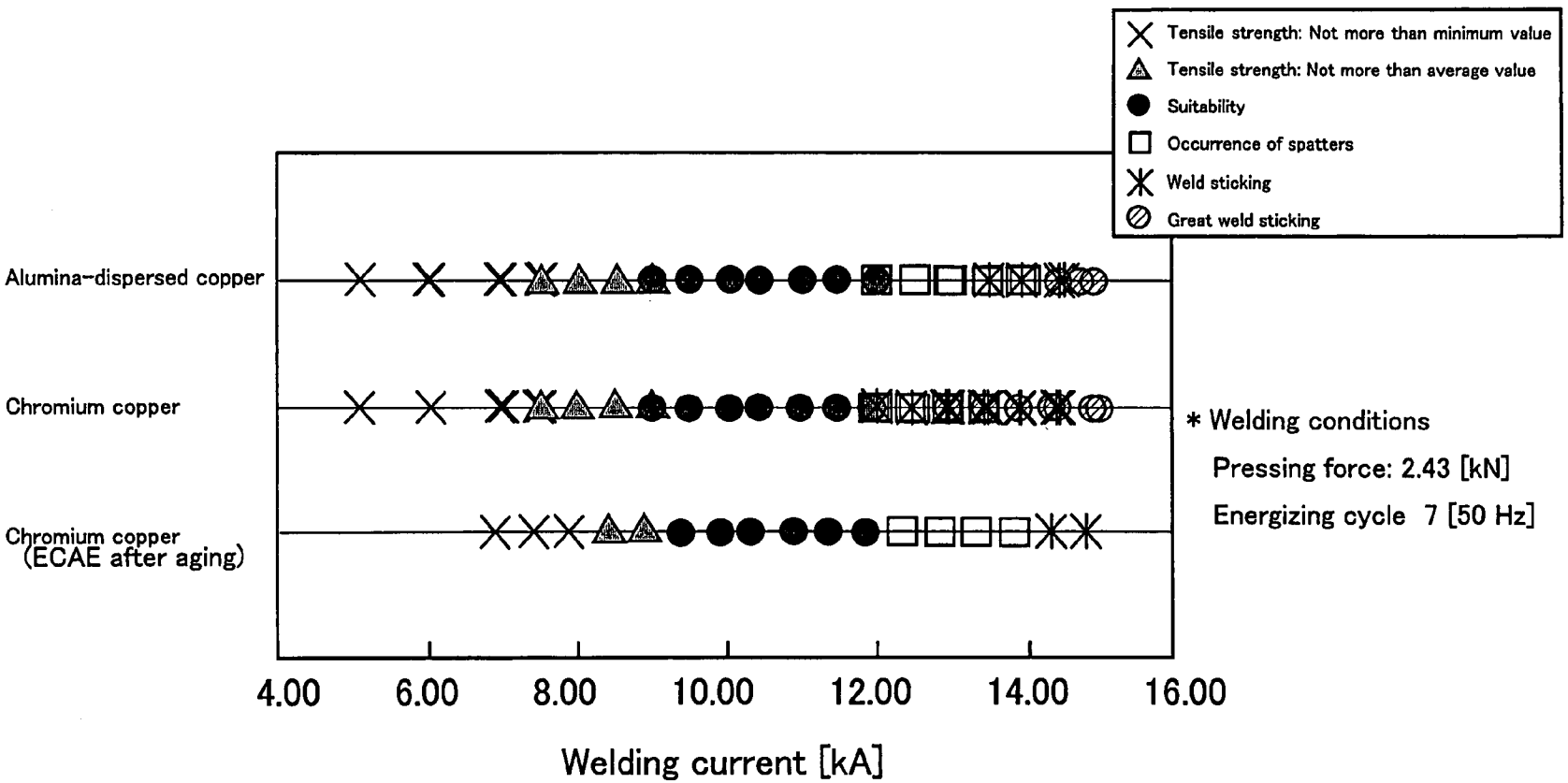
FIG. 7 is a graph that compares the weldability of a copper alloy obtained by a manufacturing method related to the invention with that of conventional copper alloys in terms of the occurrence of spatters and weld sticking.

FIG. 7 is a graph that compares the weldability of a copper alloy obtained by a manufacturing method related to the invention with that of conventional copper alloys in terms of the occurrence of spatters and weld sticking. The copper alloy related to the invention is equivalent to the alumina-dispersed copper and the copper alloy before aging treatment in terms of appropriate current conditions, and weld sticking does not occur.

Figure 8:
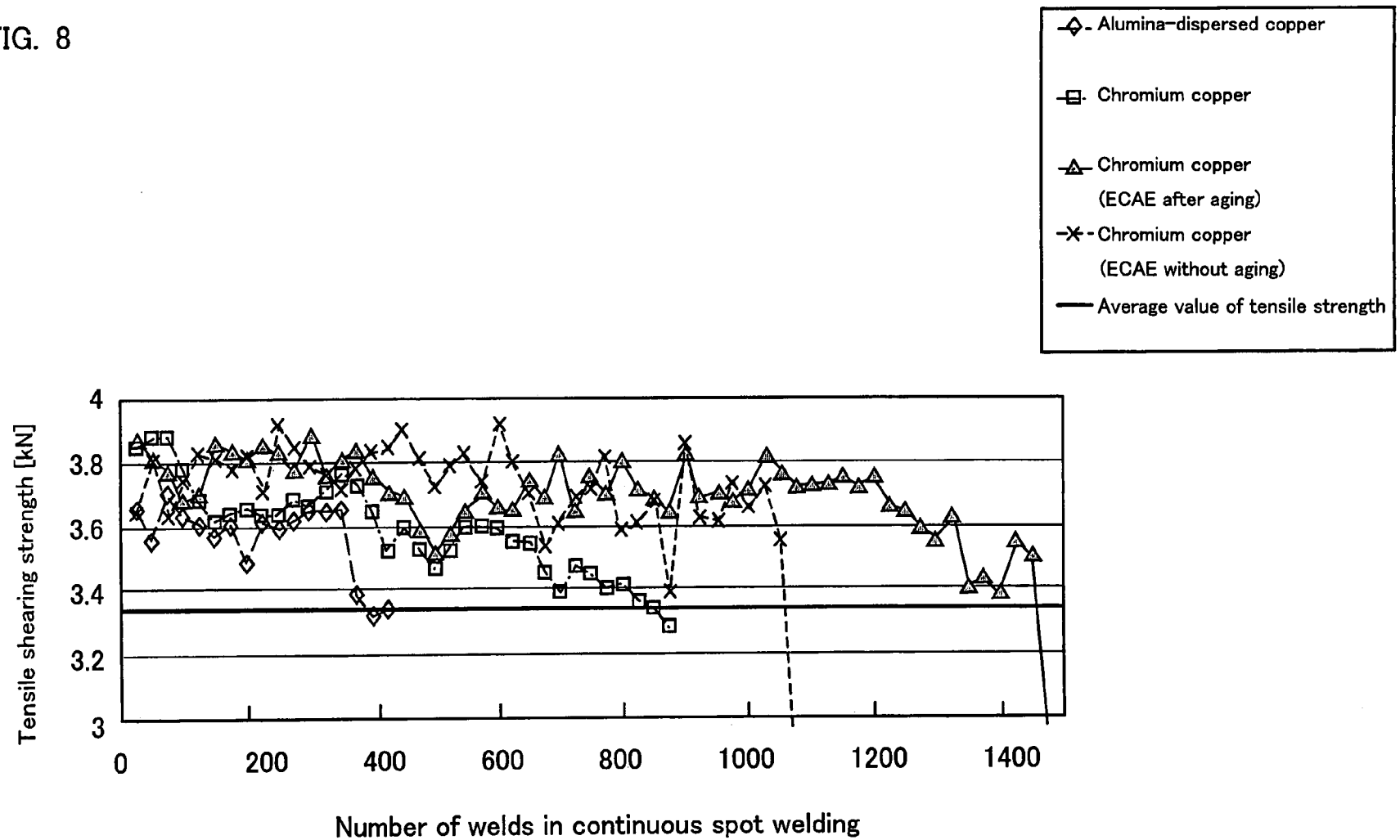
FIG. 8 is a graph that compares the weldability of a copper alloy obtained by a manufacturing method related to the invention with that of conventional copper alloys in terms of the number of welds in continuous spot welding.

FIG. 8 is a graph that compares the weldability of a copper alloy obtained by a manufacturing method related to the invention with that of conventional copper alloys in terms of the number of welds in continuous spot welding. When the copper alloy related to the invention was used as a welding tip, it was possible to produce 1475 welds in continuous spot welding.

As described above, a copper alloy related to the invention has a fine crystal structure and a large amount of added element precipitates among crystal grains and, therefore, it is possible to ensure that a copper alloy related to the invention simultaneously provides mechanical strength and thermal and electrical properties that have hitherto been in a tradeoff relation.

In particular, it is possible to obtain a copper alloy that has the properties required of an electrode material such as a welding tip, concretely, a hardness of not less than 30 HRB, an electrical conductivity of not less than 85 IACS %, and a thermal conductivity of not less than 350 W/(m·K).

Next, titanium (Ti) was selected as an element to be added and copper alloys were obtained in the same method as described above. Results are shown in FIGS. 9 to 12.

Figure 9:
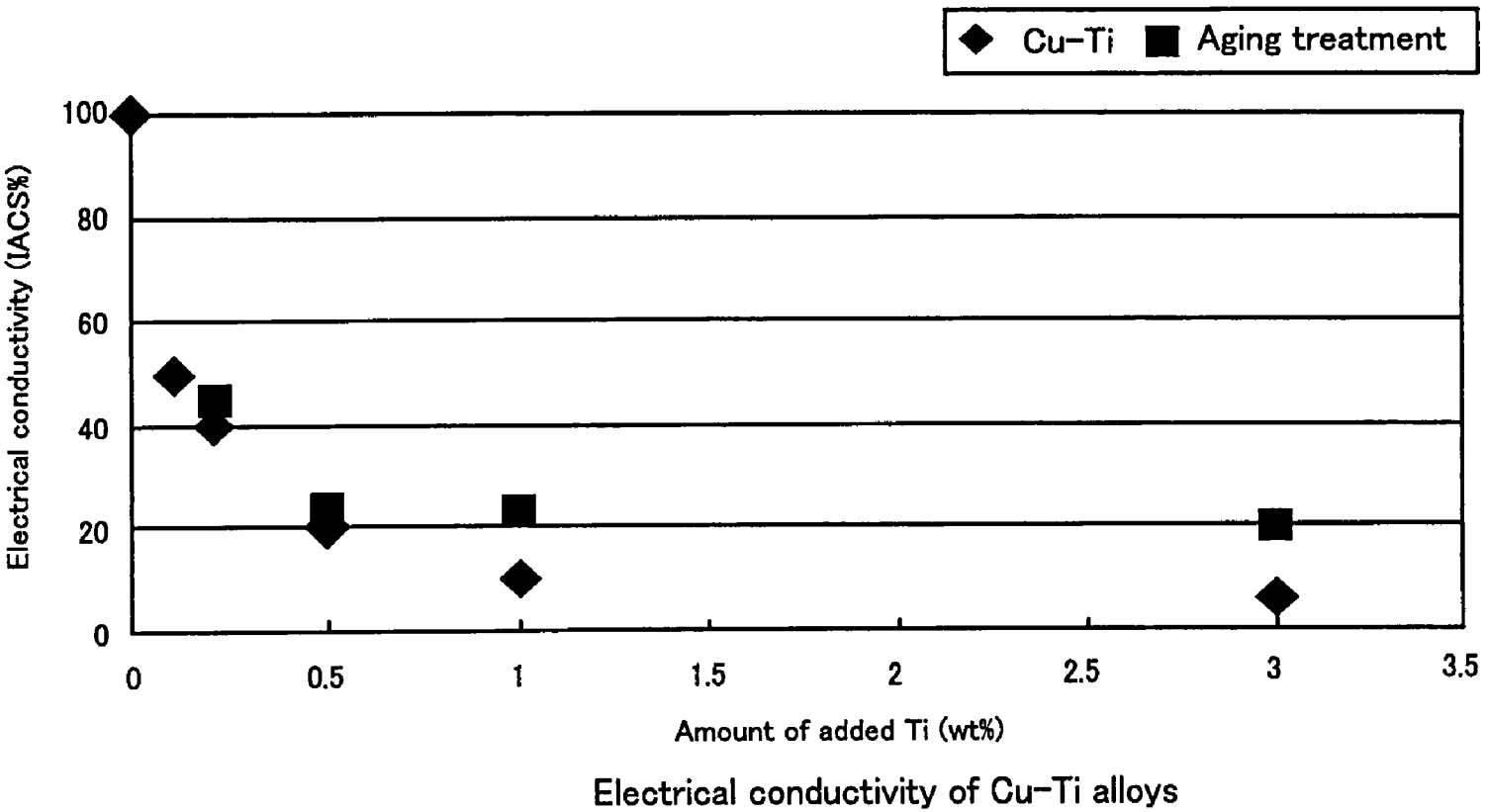
FIG. 9 is a graph that shows the relationship between the amount of added Ti and electrical conductivity of a copper alloy subjected to aging treatment and a copper alloy not subjected to aging treatment.

FIG. 9 is a graph that shows the relationship between the amount of added Ti and electrical conductivity. The maximum degree of dissolution of Ti in a solid solution state is essentially about 8 wt % and is not very large. As shown in FIG. 9, even after aging treatment, about 0.5 wt % of Ti remains in a solid solution state. It might be thought that this Ti in a solid solution state lowers the electrical conductivity of copper alloys.

Figure 10:
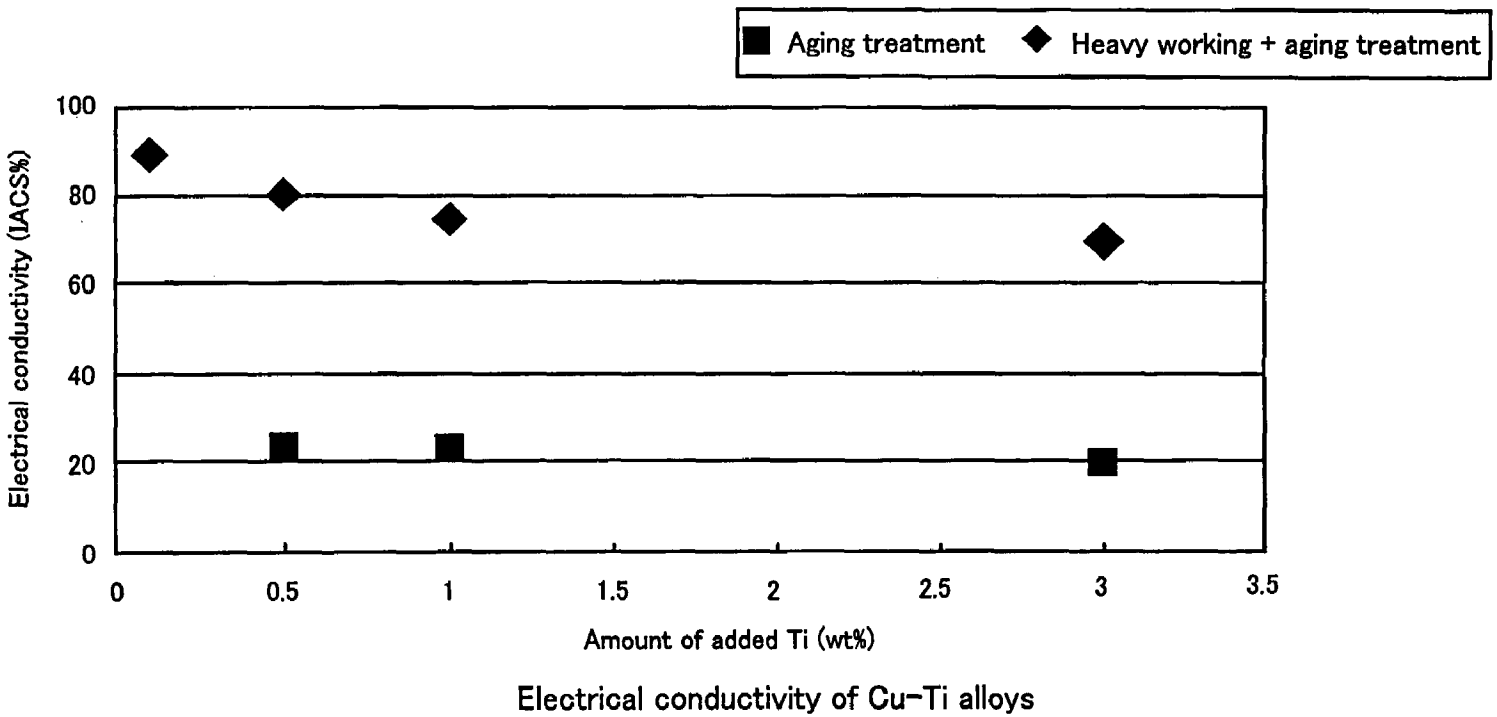
FIG. 10 is a graph that shows the relationship between the amount of added Ti and electrical conductivity of a copper alloy subjected to aging treatment and a copper alloy subjected to aging treatment and heavy working (applying a strain equivalent to an elongation of not less than 200%)

FIG. 10 is a graph that shows the electrical conductivity of a copper alloy that is heavily worked (by application of a strain equivalent to an elongation of 200%) after being subjected to aging treatment at 470° C. for two hours and the electrical conductivity of a copper alloy subjected to only aging treatment. From this graph it is apparent that the electrical conductivity of the heavily worked copper alloy increases greatly. It might be thought that this is because the Ti in a solid solution state precipitates due to heavy working.

Figure 11:
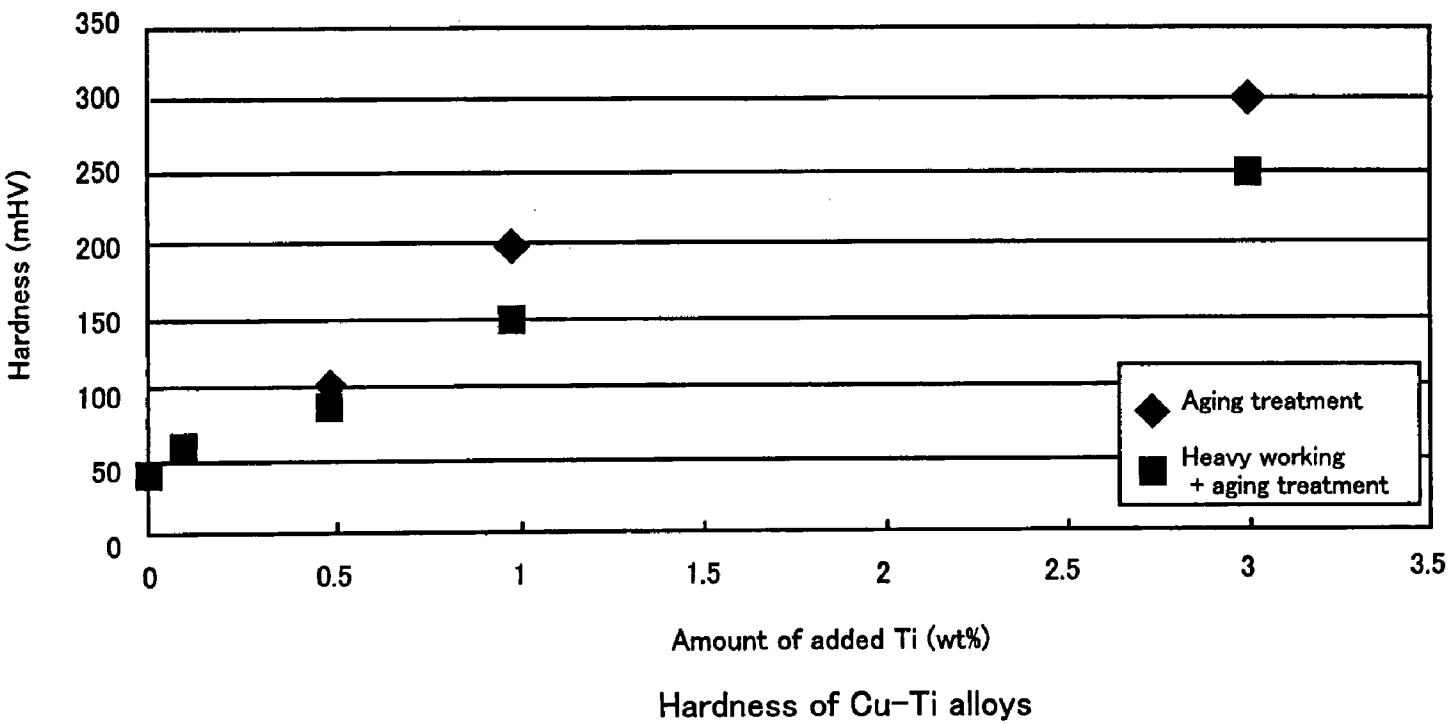
FIG. 11 is a graph that shows the relationship between the amount of added Ti and hardness (mHV) of a copper alloy subjected to aging treatment and a copper alloy subjected to aging treatment and heavy working (applying a strain equivalent to an elongation of not less than 200%)

FIG. 11 is a graph that compares the hardness of a heavily worked copper alloy with that of a copper alloy subjected to only aging treatment. As shown in this graph, the hardness of the heavily worked copper alloy is lower than that of the copper alloy subjected to only aging treatment. It might be thought that the Ti that has contributed to solid solution strengthening precipitates due to heavy working.

Figure 12:
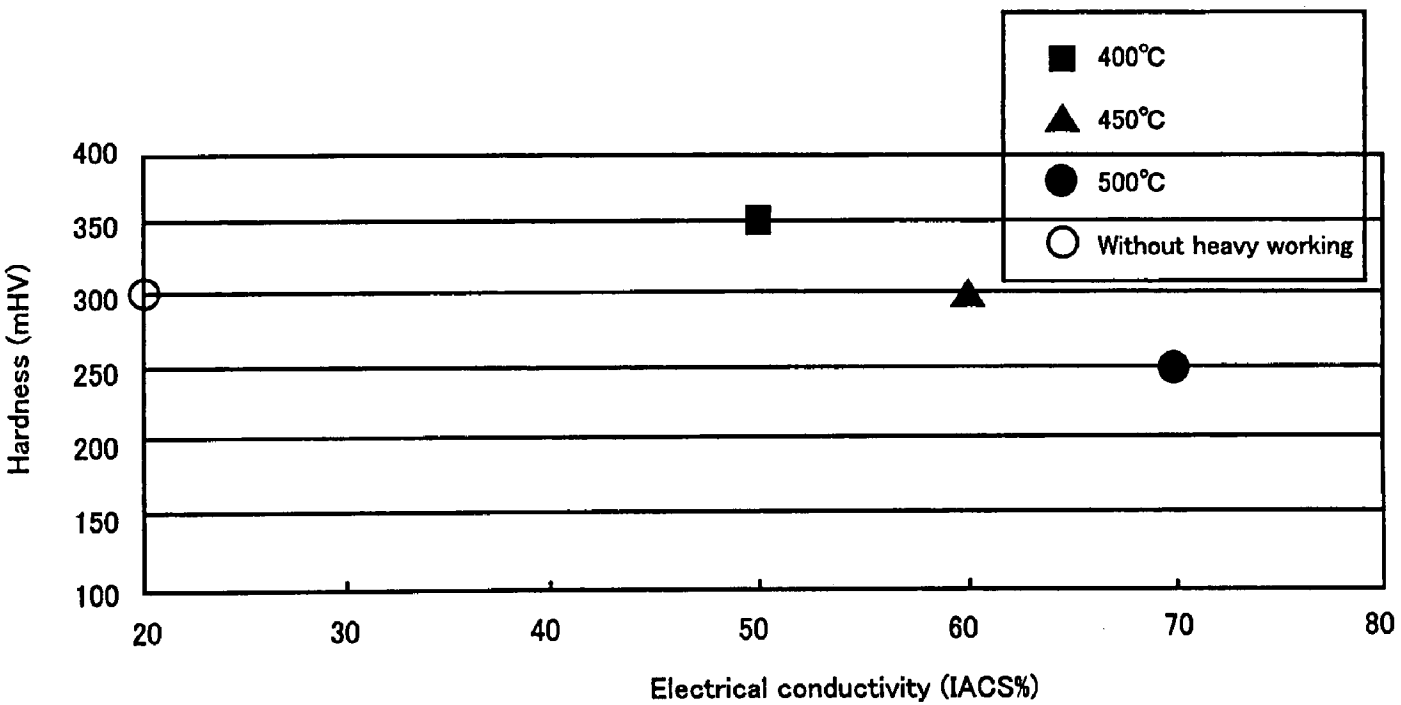
FIG. 12 is a graph that shows the relationship between electrical conductivity and hardness (mHV)

FIG. 12 is a graph that shows the relationship among hardness, electrical conductivity and heavy working temperature. From this graph it is apparent that a Cu—Ti alloy is inferior in electrical conductivity and that electrical conductivity increases although hardness decreases with increasing heavy working temperature. Also in this case, it might be thought that the Ti that has contributed to solid solution strengthening precipitates due to heavy working.

Thus, by combining heavy working with aging treatment, it becomes possible to cause the Ti that dissolves in a solid solution state to precipitate from the copper matrix although it has hitherto been impossible to cause this Ti to precipitate by aging treatment. In addition, the amount of Ti that precipitates can be controlled by controlling the degree of heavy working. Therefore, it is possible to make a copper alloy having properties that suit the purpose.

Figure 13:
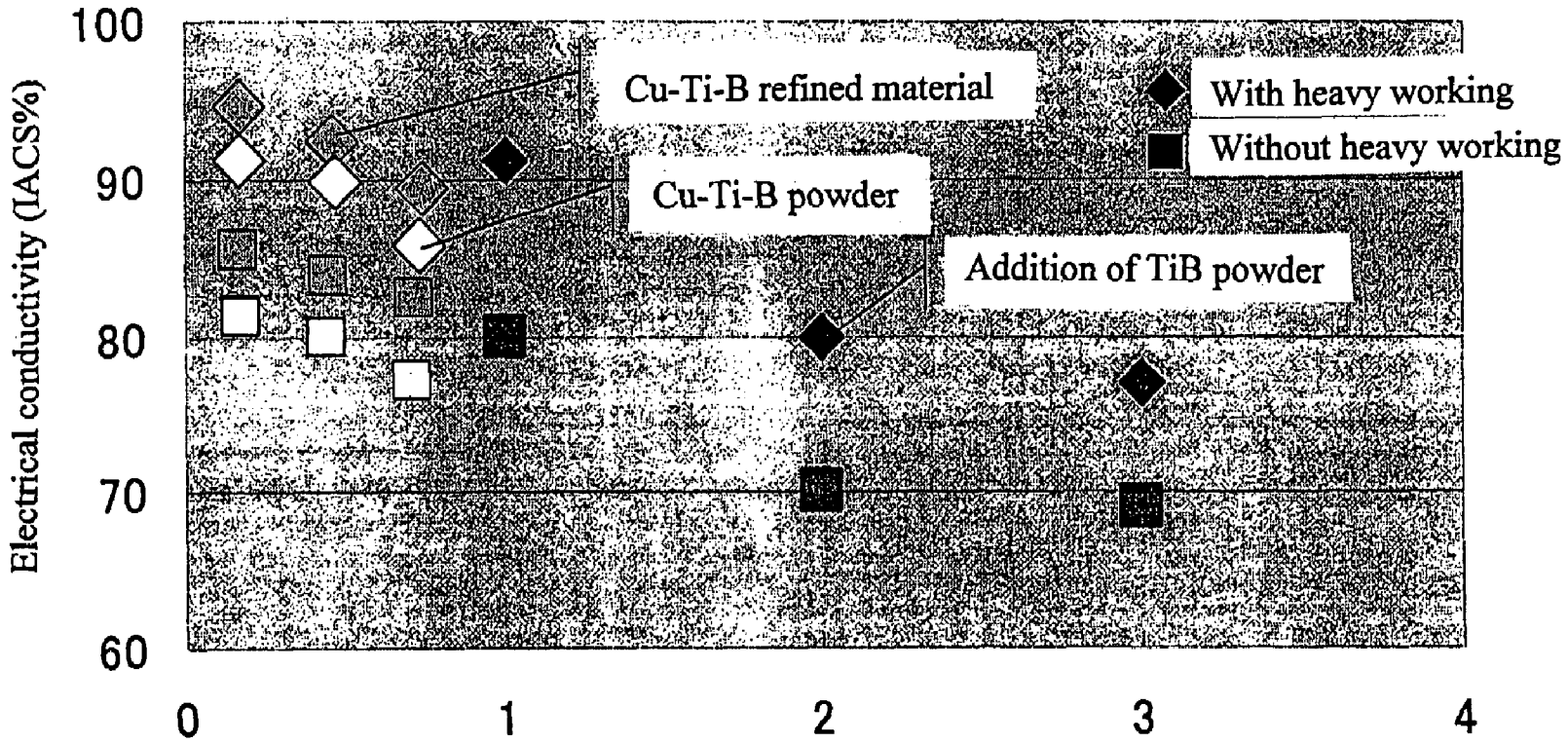
FIG. 13 is a graph that shows the relationship between methods of adding TiB and electrical conductivity.

Next, boron (B) was selected as an element to be added, and copper alloys were made by various methods. The relationship between the boron (TiB) of the obtained copper alloys and electrical conductivity is shown in FIG. 13. As methods of obtaining the copper alloys, [1] preparation of a refined material subjected to solution treatment, [2] addition of a $TiB_2$ powder as a compound (ceramic) to copper, and [3] a method of adding a Ti powder and a B powder independently to copper were adopted.

From FIG. 13, it became apparent that in all cases electrical conductivity decreases with increasing addition ratio of TiB and that in terms of manufacturing methods, the highest electrical conductivity is obtained in the case of a refined material although electrical conductivity increases by performing heavy working.

Figure 14:
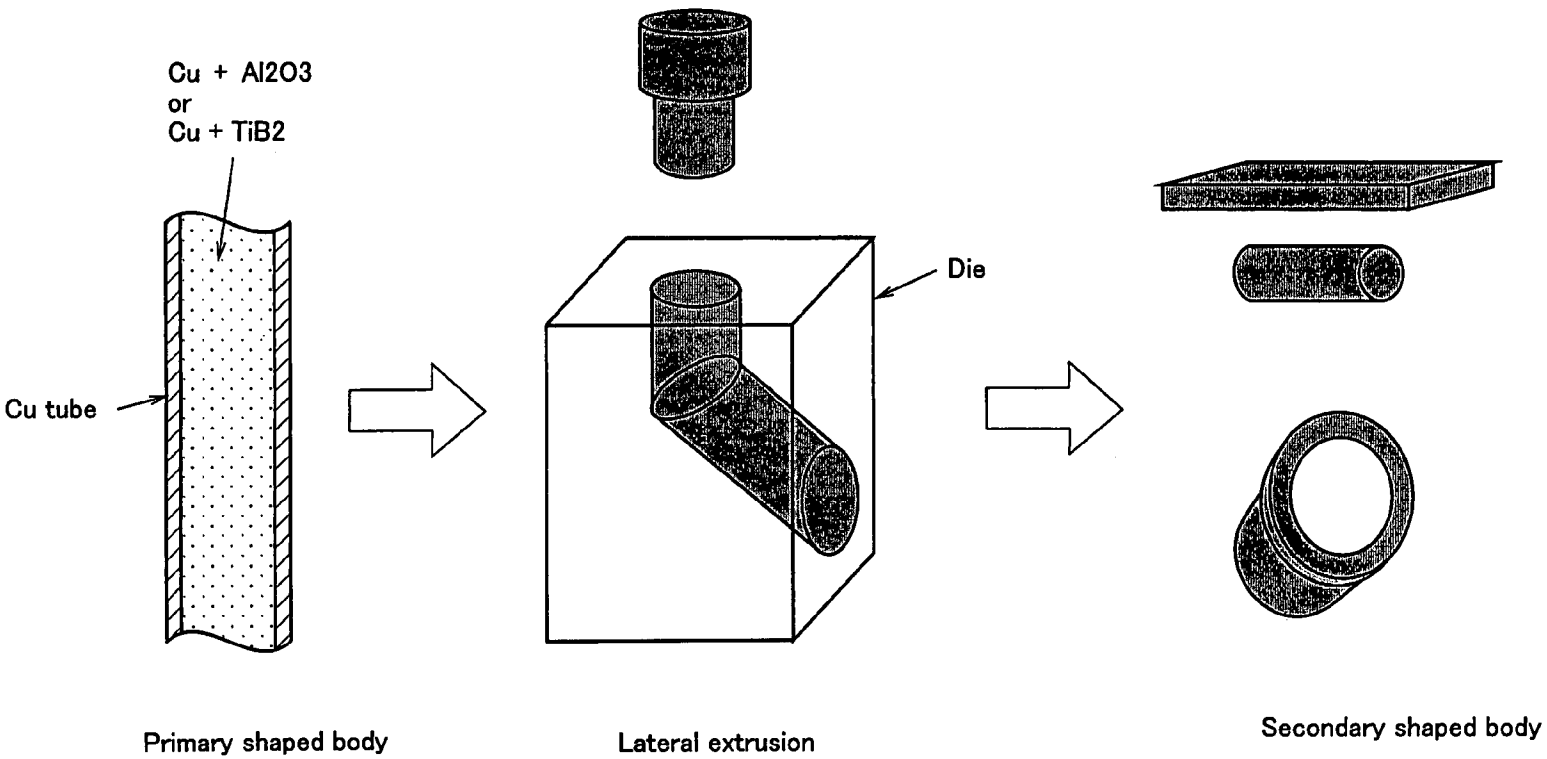
FIG. 14 is a drawing to explain a method of manufacturing a composite copper material related to the invention.
Figure 15:
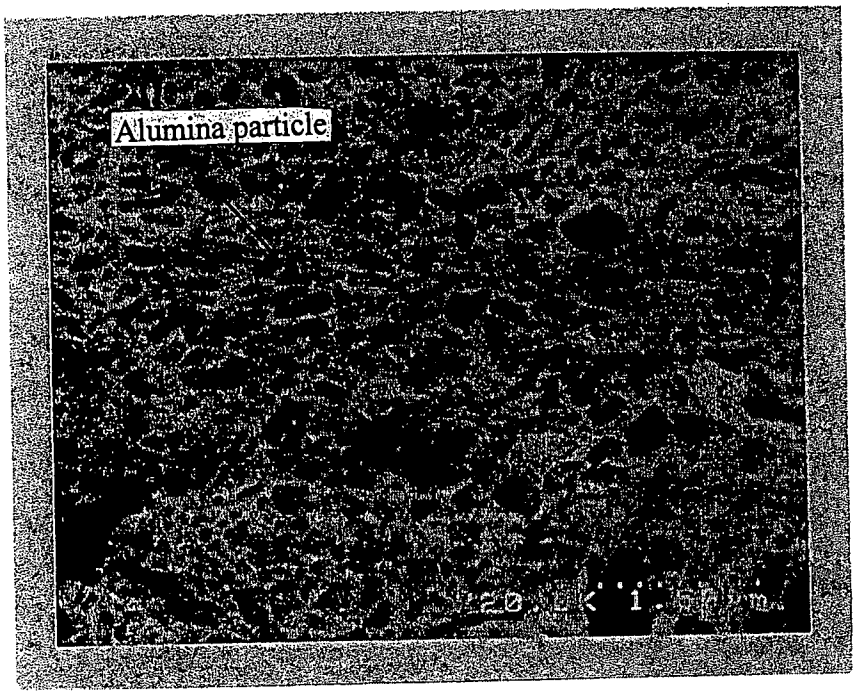
FIGS. 15(*a*) and 15(*b*) are each a micrograph of a crystal structure of a copper alloy obtained by a manufacturing method related to the invention, FIG. 15(*a*) showing a composite copper alloy to which alumina is added and FIG. 15(*b*) showing a composite copper alloy to which titanium boride is added.
Figure 15:
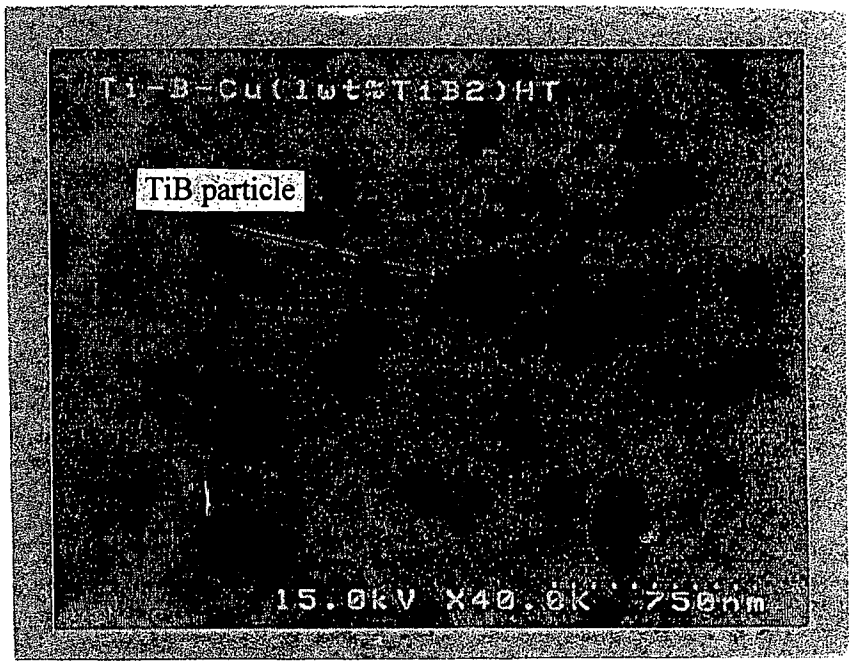
Figure 16:
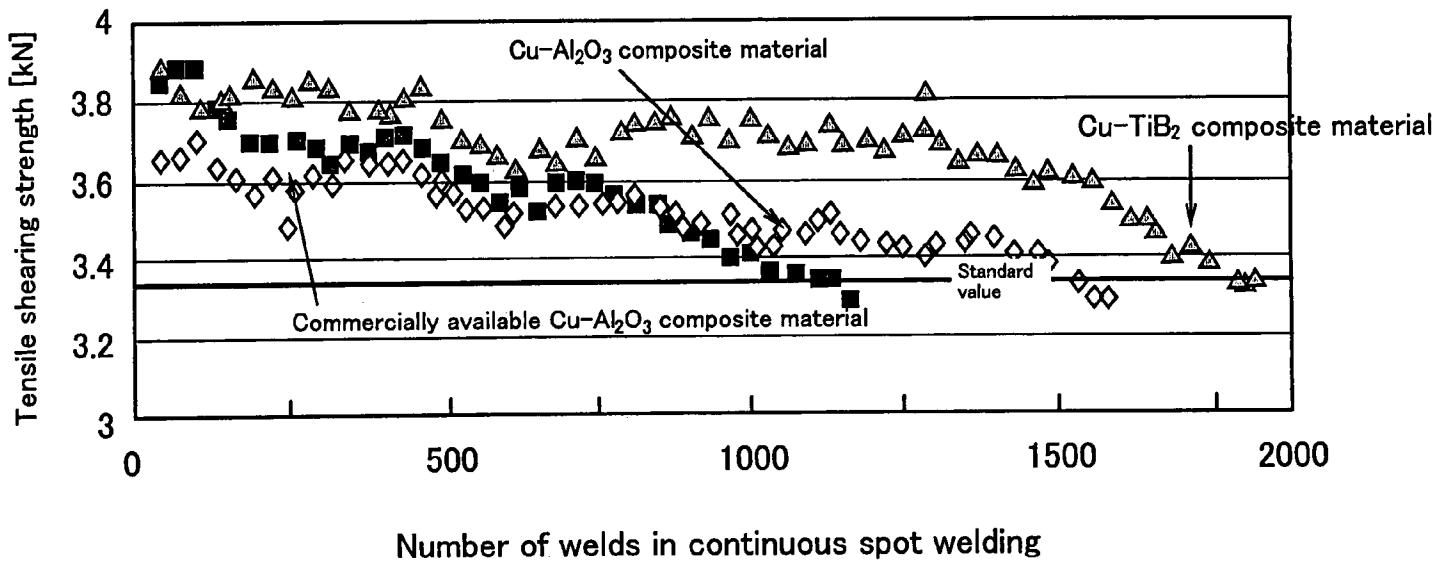
FIG. 16 is a graph that compares the weldability of composite copper materials obtained by a manufacturing method related to the invention with that of a conventional composite copper material in terms of the number of welds in continuous spot welding.

FIGS. 14 to 16 explain another embodiment (a composite copper material). First, as shown in FIG. 14, an alumina ($Al_2O_3$) powder or a titanium boride ($TiB_2$) is mixed with a base material (a Cu powder). The mixing proportion is 0.1 wt % to 5.0 wt %. If the mixing proportion is less than 0.1 wt %, wear resistance is not improved. If the mixing proportion exceeds 5.0 wt %, electrical conductivity decreases and die life also shortens. Therefore, the above-described range is specified.

Subsequently, the above-described mixed powder is formed into a primary shaped body in order to perform lateral extrusion. A primary shaped body is formed, for example, by green compacting or by filling the mixed powder in a Cu (copper) tube. Subsequently, a strain equivalent to not less than 200%, preferably, about 220% is applied to the primary shaped body by lateral extrusion.

Incidentally, in FIG. 14, for the sake of easy understanding, the diameter of the Cu tube is larger than the diameter of an insertion hole formed in the die. In actuality, however, the diameter of the Cu tube is almost the same as the diameter of the insertion hole formed in the die. The Cu tube is supported with a jig or the like so that the Cu tube does not fall while the Cu tube is being pushed in by use of a punch.

Concrete conditions for the lateral extrusion are such that the die temperature is 400 to 1000° C. and the extrusion speed is about 1 mm/sec, and ECAE treatment is performed by repeating extrusion 12 times under the conditions. By repeating the extrusion, the parent phase becomes grain-refined and the crushing and dispersion of the ceramic occur.

The micrographs of crystal structures of the copper alloys obtained by this ECAE treatment are shown in FIGS. 15(*a*) and 15(*b*). FIG. 15(*a*) shows a composite material to which an alumina powder is added, and FIG. 15(*b*) shows a composite material to which a titanium boride powder is added. From these photographs, it is ascertained that alumina or titanium boride having a particle size of several nanometers is uniformly dispersed in the copper matrix.

FIG. 16 is a graph that compares the weldability of composite copper materials obtained by a manufacturing method related to the invention with that of a conventional composite copper material in terms of the number of welds in continuous spot welding. The number of welds in continuous spot welding is about 1200 when a commercially available composite copper material in which alumina is dispersed in copper is used as a welding tip, whereas the number of welds in continuous spot welding is about 1600 in the case of an alumina-dispersed composite copper material subjected to ECAE (equal-channel-angular-extrusion) treatment and 1900 welds in continuous spot welding were possible when a composite copper material related to the invention in which titanium boride is dispersed was used as a welding tip.

Because solution treatment is not a starting point in this embodiment, there is no restriction by the limit of dissolution in a solid solution state and it is possible to arbitrarily set the proportion of the particles of a second element ($Al_2O_3$ or $TiB_2$) in a copper alloy. Therefore, it is possible to obtain properties that could not be obtained in conventional composite copper materials.

That is, the purity of the matrix of a copper alloy is high, a copper alloy is excellent in electrical properties, and the particle size of particles of $Al_2O_3$ or $TiB_2$ that precipitate at the interfaces of matrix particles is on the order of nanometers (not more than 500 nm) because of the suppression of grain growth. Also, the amount to be added can be arbitrarily set.

Next, a description will be given of an embodiment in which as a starting material, a titanium (Ti) powder and a boron (B) powder are mixed with the base material (Cu powder).

Figure 17:
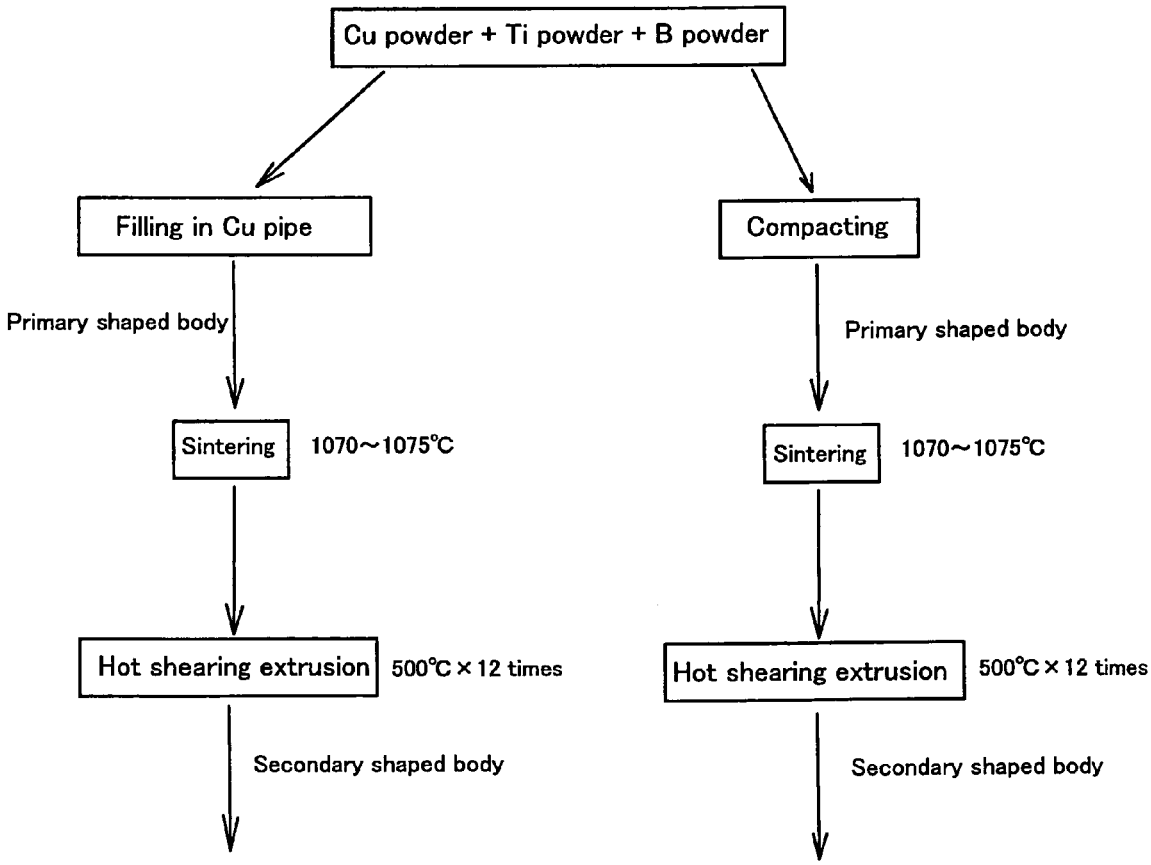
FIG. 17 is a drawing to explain a method of manufacturing a composite copper material related to the invention.

FIG. 17 is a drawing to explain the processes for obtaining a composite copper material related to the embodiment, in both of which the mixing proportion of both the titanium powder and the boron powder in the starting material is 0.1 wt % to 5.0 wt %. If the mixing proportion is less than 0.1 wt %, wear resistance is not improved. If the mixing proportion exceeds 5.0 wt %, electrical conductivity decreases and die life also shortens. Therefore, the above-described range is specified.

Subsequently, the above-described mixed powder is formed into a primary shaped body in order to perform lateral extrusion. There are available two processes for obtaining a primary shaped body. When a product to be produced is a small one like a connector and an electrode rod, the above-described mixture is filled in the Cu tube to form a primary shaped body. On the other hand, when a product to be produced is a long one or a large-sized one, a primary shaped body is formed by green compacting.

Figure 18:
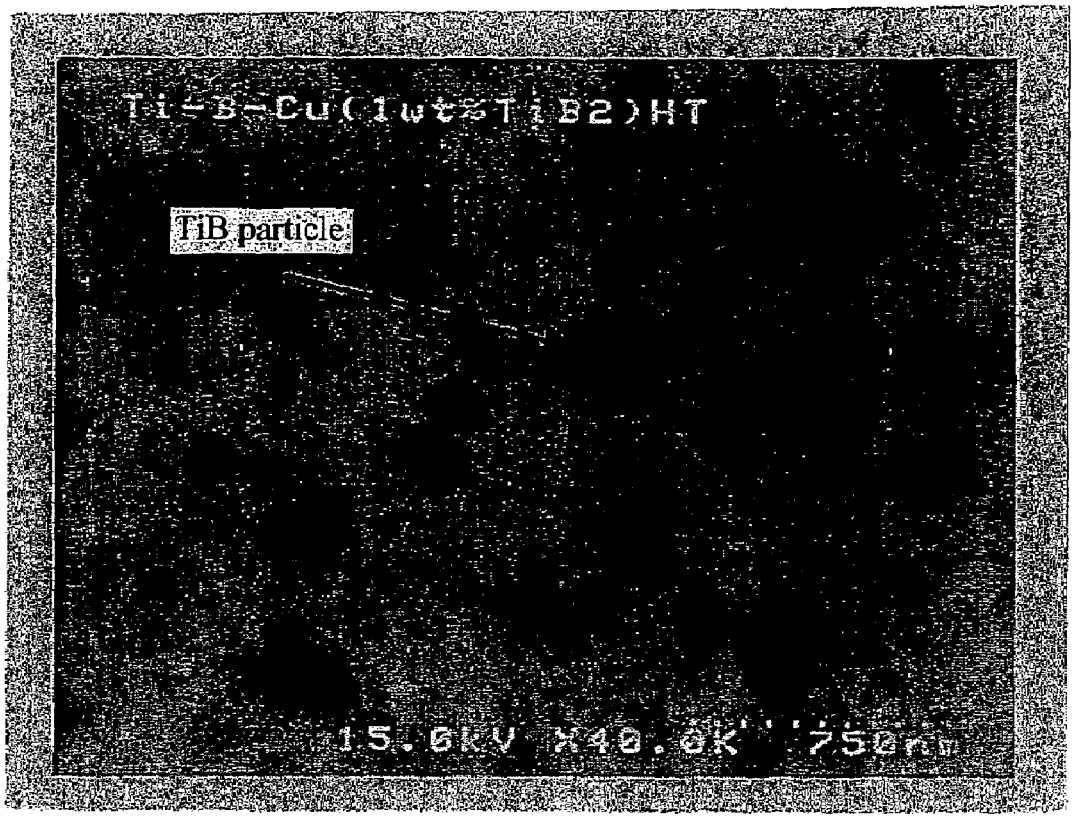
FIG. 18 is a micrograph that shows the condition of a structure after sintering.

Subsequently, the above-described primary shaped body is sintered. The added titanium (Ti) and boron (B) react due to the thermal energy resulting from this sintering to form titanium boride. FIG. 18 shows the condition of a structure after sintering. From this figure it is apparent that the titanium boride not formed before sintering is formed in the copper matrix after sintering.

Incidentally, although sintering was performed as means for applying thermal energy in the embodiment, thermal energy may be applied by means other than this.

A strain equivalent to not less than 200%, preferably not less than about 220% is applied to the primary shaped body after sintering thus obtained by lateral extrusion. The lateral extrusion is performed by the same method as described above.

Concrete conditions for the lateral extrusion are such that the material temperature is 400 to 1000° C., the die temperature is 400 to 500° C. and the extrusion speed is about 1 mm/sec, and ECAE (equal-channel-angular-extrusion) treatment is performed by repeating extrusion 12 times under the conditions. By repeating the operation, the parent phase becomes grain-refined and the crushing and dispersion of the titanium boride formed in the copper matrix occur.

Figure 19:
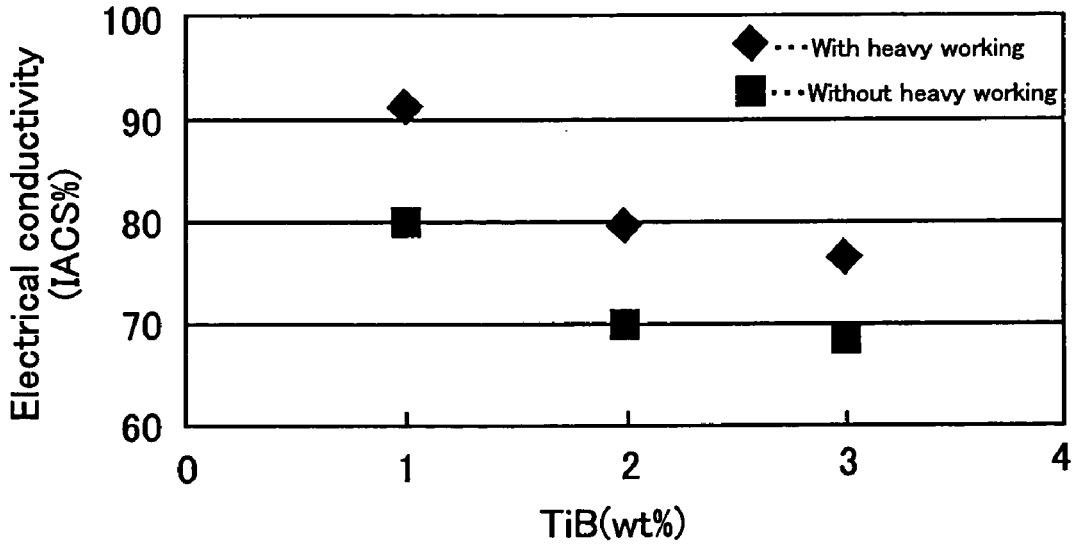
FIG. 19 is a drawing that shows the relationship between electrical conductivity and amount of added TiB when heavy working is performed and when heavy working is not performed.
Figure 20:
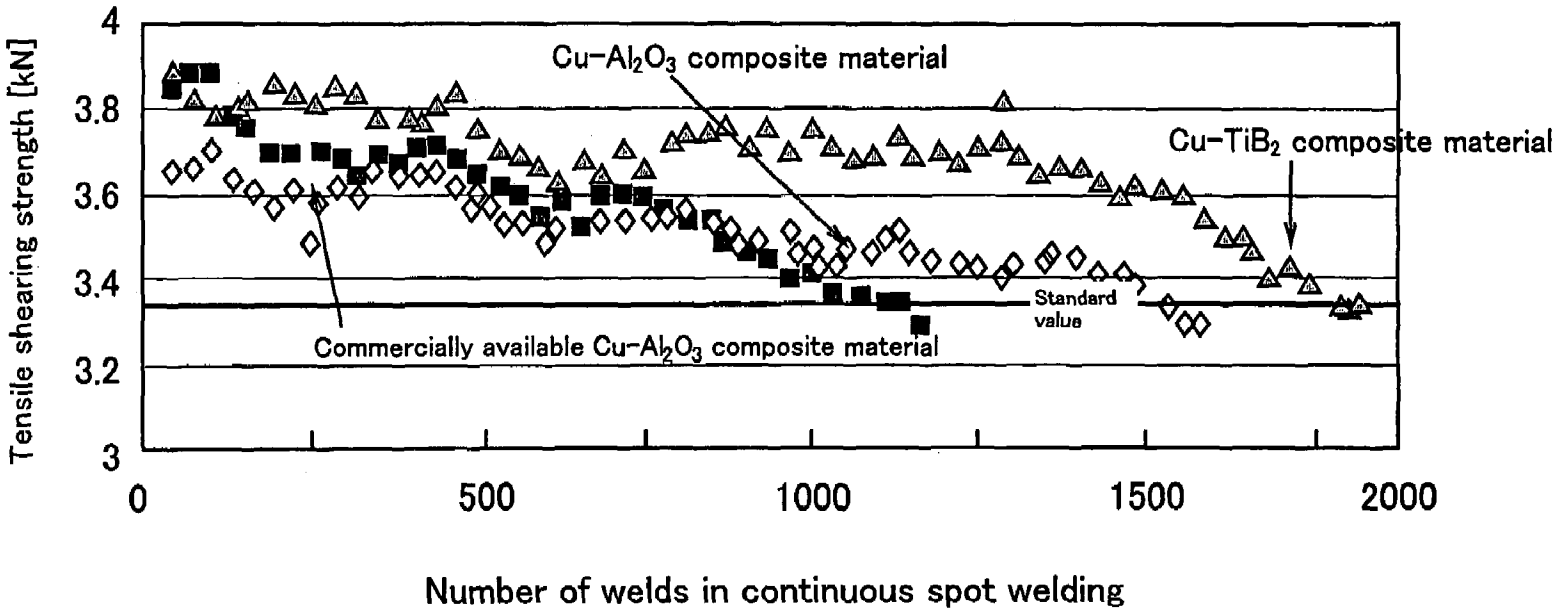

FIG. 19 is a drawing that shows the relationship between electrical conductivity and amount of added TiB when heavy working (applying a strain equivalent to an elongation of 220%) is performed and when heavy working is not performed. From this figure it became apparent that electrical conductivity is increased by heavy working. Although titanium boride having electrical conductivity is formed by the above-described heat treatment, electrical conductivity cannot be increased. It is not that the added titanium and boron react stoichiometrically, but that the added titanium and boron in a solid solution state remain within the copper matrix while they are still unreacted. Therefore, it might be thought that the unreacted solute elements (titanium and boron) precipitate when heavy working is performed, with the result that electrical conductivity increases.

Also for complex copper materials related to the invention, weldability was verified by the number of welds in continuous spot welding and the same results as shown in FIG. 16 were obtained.

Because solution treatment is not a starting point in a method of manufacturing a composite copper material related to this embodiment, there is no restriction by the limit of dissolution in a solid solution state, and it is possible to arbitrarily set titanium and boron to be added to copper, and it is possible to obtain properties that could not be obtained in conventional composite copper materials.

In particular, because titanium boride is not directly added to copper and because titanium and boron before the reaction are added to cause titanium boride to be formed in the copper matrix by the reaction by applying thermal energy to the titanium and boron before the reaction, the grain refinement of a structure (in the order of nanometers: not more than hundreds of nanometers) is promoted and mechanical strength increases.

INDUSTRIAL APPLICABILITY

A copper alloy and a composite copper material related to the invention can be used as a material for a connector that constitutes part of wiring of electric vehicles and the like or a material for welding electrodes.

The invention claimed is:

1. A method for manufacturing a copper alloy welding electrode tip of a welding machine, comprising the steps of:

enabling any of chromium (Cr), zirconium (Zr), beryllium (Be), titanium (Ti) and boron (B) to dissolve in a solid solution in a base-material metal (Cu) as a second element that does not dissolve or scarcely dissolves in copper in a solid solution state at room temperature, wherein respective addition ratios of the second element being Cr:0.1 to 1.4 wt %, Zr:0.15 to 0.5 wt %, Be:0.1 to 3.0 wt %, Ti:0.1 to 6.0 wt %, B:0.01 to 0.5 wt %, applying a strain equivalent to an elongation of not less than 200% to this material to achieve crystal grain refinement, wherein strain is applied by extruding the material, and extrusion conditions are such that lateral extrusion is performed at a material temperature of 400 to 1,000° C., a die temperature of 400 to 500° C., and an extrusion speed of 0.5 to 2.0 mm/sec, and subjecting this material to aging treatment simultaneously with or subsequent to application of this strain, thereby promoting precipitation of the second element among crystal grains.

2. A method for manufacturing a copper alloy welding electrode tip of a welding machine comprising the steps of:

enabling any of chromium (Cr), zirconium (Zr), beryllium (Be), titanium (Ti) and boron (B) to dissolve in a solid solution in a base-material metal (Cu) as a second element that does not dissolve or scarcely dissolves in copper in a solid solution state at room temperature, wherein respective addition ratios of the second element being Cr:0.1 to 1.4 wt %, Zr:0.15 to 0.5 wt %, Be:0.1 to 3.0 wt %, Ti:0.1 to 6.0 wt %, B:0.01 to 0.5 wt %, applying a strain equivalent to an elongation of not less than 200% to this material to achieve crystal grain refinement, wherein strain is applied by extruding the material, and extrusion conditions are such that lateral extrusion is performed at a material temperature of 400 to 1000° C. a die temperature of 400 to 500° C., and an extrusion speed of 0.5 to 2.0 mm/sec, and subjecting this material to aging treatment before this strain is applied to the material.

* * * * *

UNITED STATES PATENT AND TRADEMARK OFFICE

CERTIFICATE OF CORRECTION

PATENT NO. : 7,544,259 B2
APPLICATION NO. : 10/521333
DATED : June 9, 2009
INVENTOR(S) : Funaki et al.

It is certified that error appears in the above-identified patent and that said Letters Patent is hereby corrected as shown below:

On the Title Page, Section [30], Foreign Application Priority Data, second listing, delete "Jul. 18, 2002 (JP).....2003-210152" and insert --Jul. 18, 2002 (JP)....2002-210152--.

Signed and Sealed this

Tenth Day of November, 2009

David J. Kappos

David J. Kappos
*Director of the United States Patent and Trademark Office*